United States Patent [19]

Bader, Jr. et al.

[11] 4,129,253

[45] Dec. 12, 1978

[54] ELECTROMAGNETIC UNIT FUEL INJECTOR

[75] Inventors: Ernest Bader, Jr.; John I. Deckard; Dan B. Kuiper, all of Grand Rapids, Mich.

[73] Assignee: General Motors Corporation, Detroit, Mich.

[21] Appl. No.: 832,075

[22] Filed: Sep. 12, 1977

[51] Int. Cl.[2] ..... F02M 47/00

[52] U.S. Cl. ..... 239/88; 123/32 AE; 123/139 E; 239/124; 239/533.9

[58] Field of Search ..... 239/88–91, 239/93–96, 124, 533.5, 533.9, 585; 123/32 AE, 139 AE, 139 AK, 139 AR, 139 AS, 139 E

[56] References Cited

U.S. PATENT DOCUMENTS

| | | | |
|---|---|---|---|
| 3,006,556 | 10/1961 | Shade et al. | 239/88 |
| 3,368,491 | 2/1968 | Shook et al. | 239/88 X |
| 3,464,627 | 9/1969 | Huber | 239/96 |
| 4,046,112 | 9/1977 | Deckard | 123/139 E X |

*Primary Examiner*—Robert W. Saifer

*Assistant Examiner*—Andres Kashnikow

*Attorney, Agent, or Firm*—Arthur N. Krein

[57] ABSTRACT

An electromagnetic unit fuel injector for use in a diesel engine includes a housing with a pump therein defined by a cam actuated plunger reciprocable in a bushing for supplying fuel via a discharge passage in the housing to a spring biased, pressure actuated, injection valve positioned to control flow discharge out through the spray tip outlet at one end of the housing. The discharge passage is also connected to a low pressure, fuel drain passage with flow from the discharge passage, which has a metering orifice passage at one end thereof, to the drain passage being controlled by a normally open, electromagnetic valve. During a pump stroke of the plunger, the electromagnetic valve is energized to thereby block flow from the discharge passage through the metering orifice passage to the low pressure fuel drain passage whereby to allow the pressure of fuel in the discharge passage to increase during the pump stroke of the plunger whereby to effect unseating of the injection valve.

5 Claims, 6 Drawing Figures

ELECTROMAGNETIC UNIT FUEL INJECTOR

This invention relates to a unit fuel injectors of the type used for injecting fuel into the cylinder of a diesel engine and, in particular, to an electromagnetic unit fuel injector.

DESCRIPTION OF THE PRIOR ART

Unit fuel injectors of the so-called jerk-type used for the pressure injection of liquid fuel into the cylinder of a diesel engine are well known and include, in one unit, a cam actuated pump in the form of a plunger and bushing for pressurizing fuel to a relatively high pressure to effect unseating of a pressure actuated injection valve in the fuel delivery injection valve or nozzle assembly of such a unit injector. In the unit fuel injectors now commonly in use, the plunger of the pump is not only reciprocated, but it can also be rotated about its axis by means of a rack in mesh with a gear through which the plunger reciprocates whereby to control the fuel output of the injector by changing the relation of the usual helices provided on the plunger of such a unit relative to the fuel passage ports in the bushing. The plunger helices of such units have an injection timing function in addition to their metering function. As is well known, the helices of the plunger may be machined, as desired, so as to vary the time of injection at various loads with respect to the engine piston position. With such an arrangement, either or both beginning and ending of the injection may be retarded, advanced, or maintained constant with an increase in injector output, depending upon engine requirements. This feature of such unit injectors normally limits a particular injector to the one engine family class for which the injector has been designed and, of course, the particular shape of the helices on its plunger controls the operation of that injector in a fixed predetermined manner.

SUMMARY OF THE INVENTION

The present invention provides an electromagnetic unit fuel injector that includes a pump assembly having a plunger, operated from a constant velocity cam, reciprocable in a bushing, flow from the pump during a pump stroke of the plunger being directed to a fuel injection nozzle assembly of the unit that contains a spring biased, pressure actuated injection valve therein for controlling flow out through the spray tip outlets of the injection nozzle, the fuel also being directed through a passage means containing a metering orifice therein to a low pressure, fuel drain passage with flow through the metering orifice being controlled by a normally open, electromagnetic valve. Fuel injection is effected by controlled energization of the electromagnetic valve whereby to block flow through the metering orifice during a pumping stroke of the plunger so as to permit the plunger to intensify the pressure of fuel to a valve to effect unseating of the injection valve.

It is therefore the primary object of this invention to improve a unit fuel injector which is operative to reduce undesirable engine emissions, specifically unburned hydrocarbons, by permitting the electronic advancing, by actuation of an electromagnet valve, to effect the beginning of injection of the pilot and main charges independently with respect to engine revolutions per minute and load, and the nitrogen oxides by controlling the initial heat release by reducing fuel injected in the ignition delay period.

It is another object of the invention to improve a unit fuel injector for use in a diesel engine which is operative so as to effect a reduction of engine noise and mechanical stresses by the control of the injection rate profile of the main injection charge, with the flexible characteristics of pilot injection, if desired, through the use of an electromagnetic valve therein which is operative to control the build-up of pressure to effect injection.

For a better understanding of the invention, as well as other objects and further features, reference is had to the following detailed description of the invention to be read in connection with the accompanying drawings.

DESCRIPTION OF THE PREFERRED EMBODIMENT

Figure 1:
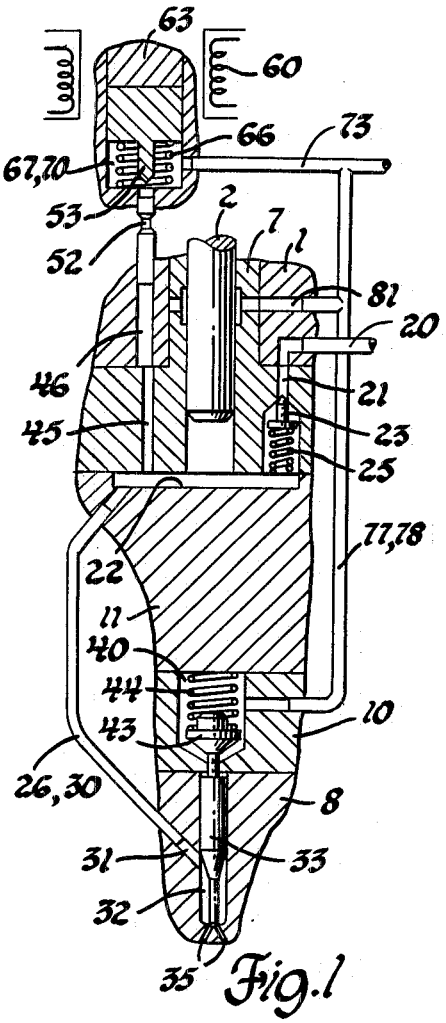
FIG. 1 is a schematic illustration of the primary operating elements of an electromagnetic unit fuel injector in accordance with the invention.

Referring now to the drawings and, in particular, to FIGS. 2 through 6, inclusive, there is shown an electromagnetic unit fuel injector in accordance with the invention, that is, in effect, a unit fuel injector-pump assembly with an electromagnetic actuated valve in the form of a solenoid valve incorporated therein to control fuel discharge from the injector portion of this assembly in a manner to be described. As shown, the electromagnetic unit fuel injector includes a hollow body or housing 1 having a pump plunger 2 and a plunger actuated follower 3 reciprocally mounted therein. The follower 3 extends out one end of the housing 1 whereby it and the plunger connected thereto are adapted to be reciprocated by an engine driven, constant velocity, cam or rocker, not shown, and by a plunger return spring 4 in a conventional manner, a stop pin 5 extending through the housing to limit upward travel of the follower 3.

Forming an extension of and threaded to the lower end of the housing 1 is a nut 6 within which is supported a bushing-cage 7 with a through bore 7*a* therethrough to provide the pump cylinder for the plunger 2, this bushing-cage hereinafter being referred to as the bushing 7, the bushing and plunger providing a fixed displacement pump. As shown, the bushing 7 is of external stepped configuration whereby its upper end is supported within the housing 1.

Nut 6 has an opening 6*a* at its lower end through which extends the lower end of a combined injector valve body or spray tip 8, hereinafter referred to as the spray tip, of a conventional fuel injection nozzle assembly. As shown, the spray tip 8 is enlarged at its upper end to provide a shoulder 8*a* which seats on an internal shoulder 6*b* provided by the through counterbore in nut 6. Between the spray tip 8 and the bushing 7 there is positioned, in sequence starting from the spray tip, a rate spring cage 10 and a director cage 11, these elements being formed, in the construction illustrated, as separate elements for ease of manufacturing and assembly. The threaded connection 12 of the nut 6 to housing 1 holds the spray tip 8, rate spring cage 10 and director cage 11 clamped and stacked end-to-end between the upper face 8*b* of the spray tip and the bottom face 7*b* of bushing 7. All of these above-described elements have lapped mating surfaces whereby they are held in pressure sealed relation to each other and, in addition, dowels, such as dowel pins 14 are used to maintain the desired aligned position of these elements to each other.

Figure 4:
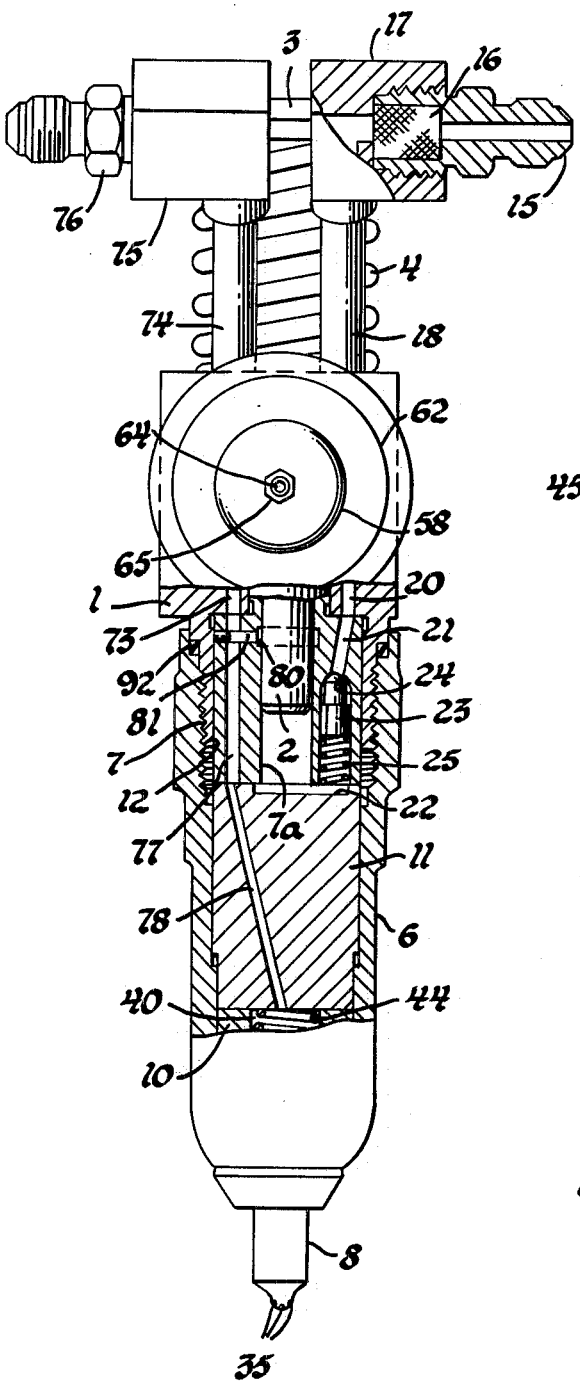
FIG. 4 is a side view taken along line 4—4 of FIG. 2 with parts broken away to show the structural relationship of various elements of the unit injector.
Figure 5:
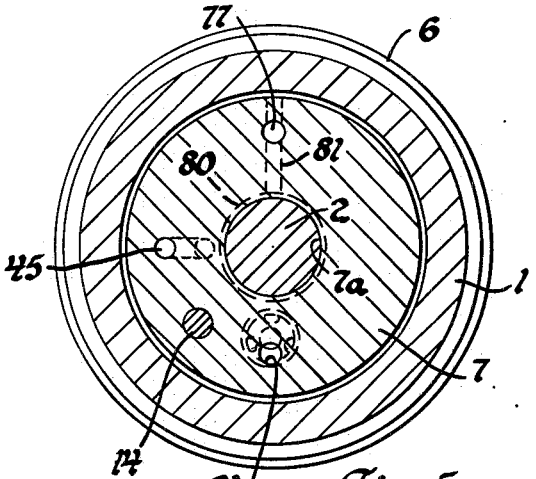
FIG. 5 is a sectional view taken along line 5—5 of FIG. 2.

Fuel, as from a fuel tank via a supply pump and conduit, not shown, is supplied at a predetermined relatively low supply pressure to the lower open end of the bushing by a fuel supply passage means which, in the construction shown, includes an apertured inlet or supply fitting 15 containing a filter 16 therein, which is threaded into an apertured elbow fitting 17 connected by a pipe fitting 18 to housing 1. The outlet from the pipe fitting 18 communicates via a passage 20 in housing 1 and a stepped passage 21 extending through the bushing 7 with a recessed cavity 22 provided in the upper end of the director cage 11, this cavity 22 being shaped so as to be in flow communication with the lower open end of the bushing 7, as best seen in FIG. 4. Flow through the inlet passage means is suitably controlled as by a one-way, fluted, check valve 23 positioned in the enlarged portion of passage 21 and biased into seating engagement against a valve seat 24 by a compression spring 25 so that, during a suction stroke of plunger 2, fuel can be drawn into the pump cylinder through the open end of bushing 7, as provided by bore 7*a*.

Figure 2:
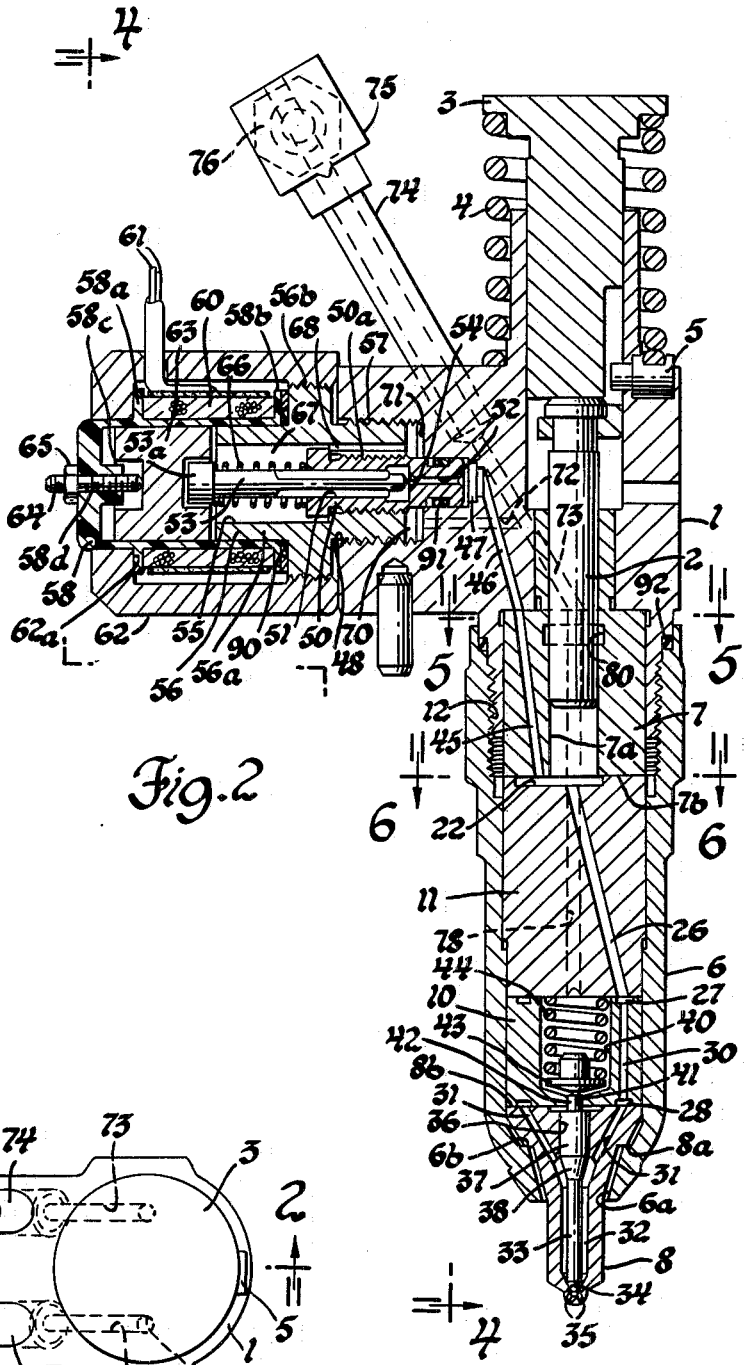
FIG. 2 is a longitudinal, sectional view of an electromagnetic unit fuel injector in accordance with the invention, this view being taken along line 2—2 of FIG. 3 with the elements of the injector being shown with the plunger of the pump thereof positioned prior to the start of a pump stroke and the electromagnetic valve means thereof de-energized.
Figure 3:
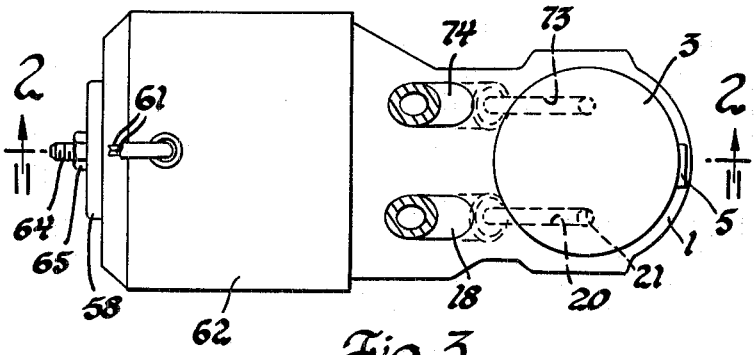
FIG. 3 is a top view of the subject electromagnetic unit fuel injector.
Figure 6:
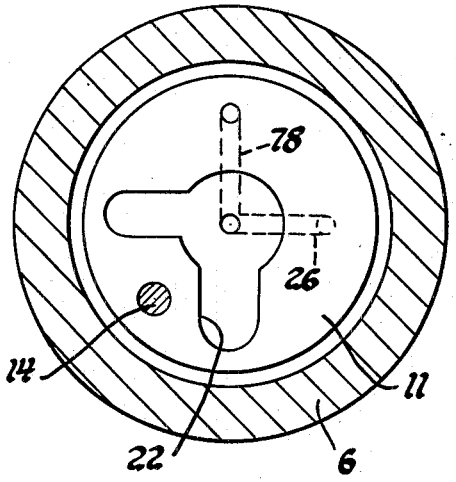
FIG. 6 is a partial sectional view taken along line 6—6 of FIG. 2.

During a pump stroke of plunger 2, fuel is discharged from the open end of the bushing 7 into the recessed cavity 22 which is of a configuration, as shown in FIGS. 2 and 6, so as to also be in communication with the inlet ends of a discharge passage means to be described. A lower part of this discharge passage means, with reference to the drawings, includes a downwardly directed passage 26 extending through the director cage 11 from the recessed cavity 22 for the flow of fuel into an annular groove 27 provided, for example, in the upper end of rate spring cage 10. This groove 27 is connected with a similar groove 28 on the bottom face of the spring cage by one or more longitudinal passages 30 extending through the spring cage 10. This lower groove 28 is, in turn, connected by a plurality of inclined passages 31 to a central passage 32 surrounding needle type injection valve 33 within the spray tip 8. At the lower end of the central passage 32 is an outlet for fuel delivery in the form of a tapered annular valve seat 34 for the injection valve, below which seat are connecting spray orifices 35 in the lower end of the spray tip 8 which open into a combustion cylinder, not shown.

The upper end of the spray tip 8 is provided with a bore 36, concentric with valve seat 34, for guiding opening and closing movements of the injection valve 33. The step piston portion 37 of the injection valve slidably fits the bore 36, and has its lower end 38 exposed to fuel pressure in the passage 32 and its upper end is exposed to fuel pressure in the spring chamber 40 by an opening 41 in the lower end of the spring cage. A reduced portion 42 of the injection valve at its upper end extends through this opening 41 into the spring chamber 40 to abut against a spring seat 43. Compressed between the spring seat 43 and the bottom surface of the director cage 11 is a coil spring 44 which biases the injection valve 33 to its closed position shown.

In accordance with the invention, the discharge passage means further includes an upper portion passage means having a metering orifice therein which is connected to a low pressure fuel drain passage means, flow through the passage means, including the metering orifice, to the drain passage means being controlled by an electromagnetic actuated valve in the form of a normally open, solenoid valve. This upper portion passage means, as best seen in FIG. 2, includes a passage 45 extending through bushing 7 and which at one or lower end is in communication with the recessed cavity 22 and at its upper end is in communication with a passage 46 in housing 1 that opens into one end of a chamber passage 47 formed in the housing by a counterbored, partly internally threaded, stepped bore 48 extending from one side of this housing. Flow from the chamber passage 47 to the drain passage means is controlled by a normally open solenoid valve and by a metering orifice.

In the construction illustrated, a valve cage 50, secured in a manner to be described, is provided with a stepped bore passage 51 therethrough providing a metering orifice passage 52, of predetermined diameter, at one end of the valve cage so that this metering orifice passage opens into the chamber passage 47. The enlarged portion of the stepped bore passage 51 in the valve cage 50 slidably receives the fluted end of a solenoid valve 53 which has a tip at this one end thereof adapted to engage a valve seat 54 encircling the metering orifice passage 52 in valve cage 50.

In the embodiment illustrated, the valve cage 50 is provided with an exterior, intermediate, externally threaded portion 50*a* which is in threaded engagement with the internally threaded portion of a stepped bore 55 extending through a tubular solenoid pole or core 56. Core 56, in turn, has an externally threaded reduced diameter end portion 57 threaded into the enlarged diameter internally threaded portion of bore 48 in housing 1, the arrangement being such that the reduced diameter end of valve cage 50 extending out from one end of the core 56 projects into a reduced diameter portion of the bore 48 next adjacent to the chamber passage 47 whereby the metering orifice passage 52 is in fluid communication with the chamber 47.

The core 56 at its opposite end is provided with a reduced diameter end portion 56*a* that extends into the open end of a cup-shaped bobbin 58 provided with a magnetic wire solenoid coil 60 wrapped around it between the radial flanges 58*a* and 58*b* thereof, this coil being connectable by electrical leads 61 to a suitable source of electrical power via a conventional fuel injection electronic control circuit, not shown, whereby the solenoid can be energized as a function of the operating conditions of an engine in a manner well known in the art.

An internally threaded cup-shaped retainer nut 62 encircling a portion of the bobbin 58 and the coil thereon is used to fix the bobbin-coil assembly to the core 56 as by having the open end of this retainer nut threaded onto the intermediate externally threaded portion 56*b* of the core 56, the inner radial shoulder 62*a* of retainer nut 62 abutting against flange 58*a* to axially retain the bobbin in position on the core 56.

A plunger-like armature 63 is slidably received in bobbin 58 adjacent its partly closed end for movement between the free end of the core 56 and a stop 64 adjustably threaded through an internally threaded aperture 58*d* at this end of the bobbin, a nut 65 being threaded onto the stop 64 to abut against the bobbin to serve both as a lock nut and seal. As shown, the armature 63 is provided with a recessed cavity at opposite ends of a diameter so as to receive the stop 64 and the internal boss 58*c* of the bobbin at one end and to receive at its opposite end the enlarged head end 53*a* of the solenoid valve 53.

A rate spring 66 is positioned to encircle the stem of the solenoid valve 53 with one end of the rate spring abutting against the free end of the valve cage 50, and the opposite end of the rate spring abutting against the head end 53*a* of solenoid valve 53 whereby to normally bias the solenoid valve to an open or unseated position relative to the valve seat 54, to the left as seen in FIG. 2, thereby normally biasing the armature 63 in the same direction into abutment against the stop 64, as shown in this Figure. With this arrangement, when the solenoid coil 60 is energized, the armature 63 is moved in the opposite direction, to the right with reference to FIG. 2, with its movement in this direction being limited by seating engagement of the tip of solenoid valve 53 against the valve seat 54 since the solenoid valve is also moved to the right by movement of the armature. Suitable clearance is provided between the armature 63 and the free end of the core 56 to permit seating of the solenoid valve 53 when the solenoid is energized.

As seen in FIG. 2, the interior of the bobbin 58 between the free end of the valve cage 50 and the armature 63 forms, with the exposed stem of the solenoid 53, a primary fuel return chamber 67 that is connected by at least one longitudinal extending passage 68 in core 56 to a secondary fuel return chamber 70 as formed by a portion of the inner annular wall provided by the bore 48 in housing 1 encircling a portion of the valve cage 50 between the fixed end of the core 56 and an inner radial shoulder 71 of the housing 1. The chambers 67 and 70 and the passage 68 form part of a fuel drain passage means for the return of fuel to the fuel tank used to supply fuel to the unit injector, this fuel drain passage means further including passage 72 opening through shoulder 71 into the chamber 70 that connects to a return passage 73 in housing 1, that is in communication with a drain fitting assembly that includes a return pipe 74, apertured elbow 75 and apertured drain fitting 76. As is conventional, the drain fitting 76 is adapted to be connected by a fuel drain conduit, not shown, to the engine fuel tank, not shown, containing fuel at a pressure corresponding substantially to atmospheric pressure.

The opposite end of passage 73 in housing 1, as best seen in FIG. 4, is in communication with a through drain passage 77 in bushing 7 that connects with an inclined downwardly directed passage 78 through the director cage 11 opening into the upper end of spring chamber 40. Any tendency of fuel pressure to build up in the spring chamber 40, as would prevent or resist opening of the injection valve 33 during an injection cycle, is prevented by venting the spring chamber through the portion of the drain passage means just described. In addition, any fuel leakage around the plunger 2 within the bushing 7 is received within an inner annulus 80 provided in the bushing 7 to encircle the plunger 2 which is then ported by a port passage 81 connected to the passage 77 of the fuel drain passage means in bushing 7.

Suitable seals 90 and 91 are provided for sealing engagement between the flange 58*b* of bobbin 58 and the core 56 and between the reduced diameter portion of valve cage 50 and the housing 1, respectively, and a seal 92 is used for sealing engagement between the housing 1 and nut 6.

FUNCTIONAL DESCRIPTION

During engine operation, fuel from a fuel tank, not shown, is supplied, at a predetermined supply pressure by a pump, not shown, through the supply fitting 15 with flow then through the inlet passage means described into the pump chamber as defined by the plunger 2 reciprocable within the internal wall 7*a* of bushing 7. At that time, fuel will be present in the discharge passage means used to supply fuel to the injection nozzle assembly and directing fuel flow, at a controlled rate, through the metering orifice passage 52 into the fuel return chambers 67 and 70, this latter flow occurring since the solenoid valve 53, with the coil 60 de-energized, is biased by the rate spring 66 to an open position, whereby to permit fuel to flow through the upper portion of the discharge passage means to exit from the injector through the fuel drain passage means described out through the apertured drain fitting 76 for return to the fuel tank, not shown.

As the follower 3 is driven downward by a constant velocity cam, either directly by the cam or by a rocker, neither being shown, to effect downward movement of the plunger 2, this downward movement of the plunger on its pump stroke will cause the pressure of fuel in the pump cylinder cavity 22 and the discharge passage means to rise to a pressure level that is a predetermined amount less than the pressure required to lift the injection valve 33 from the valve seat 34 against the downward load force of the rate spring 44. This pressure level is predetermined and is readily controlled by proper sizing of the metering orifice passage 52 preferably provided in the valve cage 50, for ease in manufacturing and assembly.

During the downward stroke of the plunger 2, an electrical (current) pulse of finite characteristic and duration (timed relative to the top dead center of the engine piston position with respect to the camshaft and rocker arm linkage, not shown) applied through the leads 61 to the coil 60 produces an electromagnetic field attracting the armature 63 to the solenoid pole or core 56 thereby moving the solenoid valve 53 in a direction so as to seat against its valve seat 54 thereby blocking further flow of fuel through the metering orifice passage 52, and permitting the plunger 2 to intensify (increase) the fuel pressure to the injection valve 33 "pop" pressure thereby lifting this valve from the valve seat 34 to permit the injection of fuel out through the spray orifices 35, the injection pressure continuing to increase during further downward motion of the plunger 2.

Ending of the current pulse causes the magnetic field to collapse, allowing the rate spring 66 to lift the solenoid valve 53 from the valve seat 54 in the valve cage to thereby permit flow through the metering orifice passage 52 at a controlled rate thereby releasing the system pressure in the discharge passage means and in the passage 55 of spray tip 8 to the drain passage means.

With this mode of operation, it will be apparent that the injection pressure profile is controlled and determined by the electronic drive circuit characteristics, as desired. The fixed displacement of fluid via the plunger 2 in bushing 7 is predetermined so that during a single pump stroke of the plunger 2, a sufficient volume of fuel is supplied by this pump structure so as to permit the intensification of the fuel pressure and injection of fuel whereby to provide both pilot and main charge injection, as desired.

It will now be apparent to those skilled in the art that the subject electromagnetic unit fuel injector, although driven from a constant velocity cam drive, is operative whereby to provide controlled fuel pressure intensification with a fixed displacement bushing-plunger pump assembly. The pressure rate increase within the unit injector is restrained below the "pop" pressure of the injector spray tip injection valve by a normally open solenoid control orifice valve, that is, solenoid valve 53 and metering orifice passage 52. Electromagnetic closure of this valve allows the pressure within the unit injector to further increase or build up to a value operative to effect unseating of the injection valve 33 whereby to permit injection of fuel into the combustion chamber of an engine, not shown. Electromagnetic pulse width control of the solenoid valve in the subject electromagnetic unit fuel injector provides the variable timing control with a pilot injection option, that is not available with conventional unit fuel injector.

What is claimed is:

1. An electromagnetic unit fuel injector including a housing means having a fuel inlet and a fuel drain outlet at one end thereof and including a spray tip valve body means terminating in a spray outlet at its other end, a pump cylinder in said housing means, a plunger reciprocable in said cylinder, said cylinder being open at one end for the ingress and egress of fuel during reciprocation of said plunger, a valve controlled inlet pasage means in said housing means connecting said inlet to said open end of said cylinder, discharge passage means in communication with said open end of said cylinder, said discharge passage means including an injection fuel delivery passage that terminates at said spray outlet, an injection valve movably positioned in said delivery passage and having one end thereof normally positioned to close said spray outlet and, conduit means including a metering orifice passage means in fluid flow communication at one end with said discharge passage means and said open end of said cylinder and at its opposite end with said fuel drain outlet and, a normally open solenoid valve operatively positioned to control flow through said metering orifice passage means to said fuel drain outlet whereby, during a pump stroke of said plunger, fuel discharged under pressure thereby is directed to said spray outlet as controlled by said injection valve and is throttled through said metering orifice passage means to said fuel drain outlet and, when said solenoid actuated valve is closed to block fluid flow through said metering orifice passage means to said drain outlet, the pressure of fuel delivered during the continued pump stroke of said plunger is intensified sufficiently so as to build up sufficient fuel pressure in said injection fuel delivery passage to effect unseating of said injection valve.

2. An electromagnetic unit fuel injector including a housing means having a fuel inlet and a fuel drain outlet at one end thereof, the said housing means including a valve body terminating in a spray outlet at its other end, a pump cylinder in said housing means, a plunger reciprocable in said cylinder, said cylinder being open at one end for the ingress and egress of fuel during reciprocation of said plunger, a valve controlled inlet passage means in said housing means connecting said inlet to said open end of said cylinder, discharge passage means connected at one end to said open end of said cylinder, said discharge passage means including an injection fuel delivery passage means terminating at a spray outlet, an injection valve movable in said delivery passage means and having one end thereof adapted to close said spray outlet, a spring chamber in said housing means, said injection valve having its other end thereof projecting into said spring chamber, a spring means in said spring chamber normally biasing said injection valve in a direction to normally close said spray outlet, and conduit means including a normally open, solenoid actuated valve controlled metering orifice passage connected at one end to said discharge passage means and connected at its other end in fluid communication with said drain outlet whereby the pressure rate increase of fluid in said fuel delivery passage means during a pump stroke of said plunger is restrained by fuel flow through metering orifice passage until said solenoid actuated valve is closed.

3. An electromagnetic unit fuel injector including a housing means having a fuel inlet and a fuel drain outlet at one end thereof and including a valve body, terminating in a spray outlet at its other end, a pump cylinder in said housing means, a plunger reciprocable in said cylinder, said cylinder having an open end for the ingress and egress of fuel during reciprocation of said plunger, a valve controlled inlet passage means in said housing means connecting said inlet to said open end of said cylinder, discharge passage means connected at one end to said open end of said cylinder, said discharge passage means including an injection fuel delivery passage in said valve body terminating at said spray outlet, an injection valve movable in said valve body with one end thereof adapted for movement between a closed position and an open position relative to said spray outlet, a spring chamber in said housing means, spring means in said spring chamber operatively connected to said injection valve to normally bias said injection valve to said closed position, drain passage means in said housing means connected at one end to said drain outlet, said drain passage means including a drain conduit means operatively connected to said spring chamber to permit drainage of fuel therefrom, said housing means further having a fuel return chamber therein, said drain passage means being connected at an opposite end to be in communication with said fuel return chamber, and a normally open, solenoid valve controlled passage means, including a metering orifice, operatively connected at one end to said fuel return chamber and at its other end connected in fluid communication with said discharge passage means.

4. An electromagnetic unit fuel injector including a housing means having a fuel inlet and a fuel drain outlet, a pump cylinder in said housing means, a cam actuated plunger reciprocable in said cylinder, said cylinder being open at one end for discharge of fuel displaceable by said plunger during a pump stroke and for fuel intake during a suction stroke of said plunger, a valve controlled fuel inlet passage means connecting said fuel inlet to said open end of said cylinder, said housing means including a valve body having a spray outlet at one end thereof for the discharge of fuel, an injection valve movable in said valve body between an open position and a closed position relative to said spray outlet, a discharge passage means connecting said cylinder open end to said spray outlet, a spring chamber means in said housing means, a bore in said valve body slidably guiding said injection valve and opening into said spring chamber means, said injection valve having a piston portion exposed to fuel pressure in said discharge passage means adjacent said spray outlet for effecting movement of said injection valve to said open position, a spring means positioned in said spring chamber means for abutment against one end of said injection valve to normally bias said injection valve to said closed position, a drain passage means including a fuel return chamber connected at one end to said fuel drain outlet, said discharge passage means including a conduit means having a metering orifice therein operatively connected at one end to said discharge passage means and at its opposite end to said fuel return chamber of said drain passage means, and a normally open, solenoid actuated valve operatively positioned to control fuel flow from said discharge passage means through said metering orifice to said fuel return chamber.

5. An electromagnetic unit fuel injector including a housing means having a fuel inlet and a fuel drain outlet at one end thereof, a fuel injector including a valve body carried by said housing means at its opposite end, said valve body having a spray outlet at one end exterior of said housing means, an injection valve movable in said valve body between an open and a closed position relative to said spray outlet, a pump cylinder in said housing means, a cam actuated plunger reciprocable in said cylinder, said cylinder having an open end for the ingress and egress of fuel during a suction stroke and a pumping stroke, respectively, of said plunger, a valve controlled inlet passage means in said housing means connecting said inlet to said open end of said cylinder, discharge passage means connected at one end to said open end of said cylinder and terminating at an opposite end at said spray outlet, a spring chamber in said housing means, a spring means positioned in said spring chamber, said injection valve having its end opposite said spray outlet operatively connected to said spring means whereby said injection valve is normally biased to the closed position, said discharge passage means further including conduit means having a metering orifice therein at an end thereof opposite said spray outlet, a drain passage means connected at one end to said fuel drain outlet and operatively connected to said conduit means downstream of said metering orifice, said drain passage means also being operatively connected to said spring chamber, and a normally open, solenoid actuated valve controlling flow through said metering orifice to said drain passage means whereby to restrain the pressure of fuel in said discharge passage means during a pump stroke of said cam actuated plunger until said solenoid actuated valve is closed.

* * * * *